US008834216B1

(12) United States Patent
Calamia et al.

(10) Patent No.: US 8,834,216 B1
(45) Date of Patent: Sep. 16, 2014

(54) WATER DEFLECTOR FOR A MARINE OUTBOARD ENGINE

(71) Applicant: BRP US Inc., Sturtevant, WI (US)

(72) Inventors: Dave Calamia, Burlington, WI (US); Mark Noble, Pleasant Prairie, WI (US); Jeff Turner, Beach Park, IL (US); Brian Hanover, Kenosha, WI (US); Jerry Ewens, Pleasant Prairie, WI (US); Guillaume Longpre, Valcourt (CA)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 13/755,580

(22) Filed: Jan. 31, 2013

(51) Int. Cl.
*B63H 5/16* (2006.01)
*B63H 20/06* (2006.01)
*B63H 20/34* (2006.01)

(52) U.S. Cl.
CPC ..... *B63H 20/34* (2013.01); *B63H 20/06* (2013.01)
USPC ..... 440/66; 114/274

(58) Field of Classification Search
USPC ..... 440/66; 114/274
IPC ..... B63H 5/16
See application file for complete search history.

(56) References Cited

U.S. PATENT DOCUMENTS 3,162,412 A 12/1964 McEntire
3,564,113 A 2/1971 Kindler
4,348,194 A 9/1982 Walsh
4,416,475 A 11/1983 Stacey
4,517,408 A 5/1985 Pegram
4,623,313 A 11/1986 Ferguson
4,652,072 A 3/1987 Arasi, Jr.
4,657,513 A 4/1987 Baker
4,708,673 A 11/1987 Dunham et al.
4,753,619 A 6/1988 Sullivan
4,781,634 A * 11/1988 Harris et al. ..... 440/66
4,864,080 A 9/1989 Fochler et al.
4,932,875 A 6/1990 Ogawa et al.
4,969,847 A 11/1990 Curtis et al.
5,052,353 A 10/1991 Dunham et al.

(Continued)

FOREIGN PATENT DOCUMENTS

GB 2161772 A 1/1986
JP 6220794 1/1987

OTHER PUBLICATIONS

English Abstract of JP6220794, Published Jan. 29, 1987; Retrieved from http://worldwide.espacenet.com/ on May 27, 2013.

*Primary Examiner* — Stephen Avila
(74) *Attorney, Agent, or Firm* — BCF LLP

(57) ABSTRACT

A stern bracket for mounting a drive unit to a watercraft including a transom. The drive unit is pivotable with respect to the stern bracket about a tilt axis. The stern bracket includes a support member for fixing the drive unit to the transom and a water deflector. The water deflector comprises a mounting bracket attached to the support member and a deflection plate connected to the mounting bracket. The deflection plate, disposed at a vertical position lower than the tilt axis, extends between the transom and the drive unit mounted to the stern bracket mounted to the transom. A left deflection wing, connected to at least one of the deflection plate and the mounting bracket, extends downward and laterally outward therefrom. A right deflection wing, connected to at least one of the deflection plate and the mounting bracket, extends downward and laterally outward therefrom. A watercraft is also disclosed.

20 Claims, 11 Drawing Sheets

(56) References Cited

U.S. PATENT DOCUMENTS

| | | | |
|---|---|---|---|
| 5,078,629 | A | 1/1992 | Mondek |
| 5,080,618 | A | 1/1992 | Dunham et al. |
| 5,129,847 | A | 7/1992 | Mondek |
| 5,176,551 | A | 1/1993 | Blanchard et al. |
| 5,637,021 | A | 6/1997 | Watanabe |
| 5,836,212 | A | 11/1998 | Batess |
| 5,967,865 | A | 10/1999 | Nakamura et al. |
| 6,048,236 | A | 4/2000 | Natsume |
| 6,183,322 | B1 | 2/2001 | Takahashi |
| 6,257,940 | B1 | 7/2001 | Dunham et al. |
| 6,283,807 | B1 | 9/2001 | Kokubo et al. |
| 6,364,724 | B1 | 4/2002 | Nozawa et al. |
| 6,915,771 | B2 | 7/2005 | Watanabe |
| 6,923,695 | B2 | 8/2005 | Ide et al. |
| 6,960,108 | B1 | 11/2005 | Jaszewski et al. |
| 7,104,856 | B1 | 9/2006 | Krupp et al. |
| 7,500,891 | B2 | 3/2009 | Yazaki |
| 7,510,451 | B2 | 3/2009 | Inaba |
| 7,621,791 | B2 | 11/2009 | Yazaki et al. |
| 7,704,109 | B2 | 4/2010 | Arai et al. |
| 7,987,804 | B2 * | 8/2011 | Shiomi et al. ..... 114/274 |
| 8,210,886 | B1 | 7/2012 | Pelini |

* cited by examiner

WATER DEFLECTOR FOR A MARINE OUTBOARD ENGINE

FIELD OF THE INVENTION

The present invention relates to marine outboard engines, and more specifically to splash plates for marine outboard engines.

BACKGROUND

A marine outboard engine generally comprises a bracket assembly that connects the drive unit of the marine outboard engine to the transom of a boat. The drive unit includes an internal combustion engine and a propeller. The marine outboard engine is typically designed so that the steering angle and the tilt/trim angle of the drive unit relative to the boat can be adjusted and modified as desired.

It is known that water can splash up between the transom and the outboard engine onto upper sections of the drive unit and/or into the boat from the stern. Therefore, there is a need for a system to prevent water from splashing into the boat and/or onto the upper section of the drive unit regardless of the tilt/trim/steering configuration of the drive unit.

SUMMARY

It is an object of the present invention to ameliorate at least some of the inconveniences present in the prior art.

In one aspect, the present provides a stern bracket for mounting a drive unit to a watercraft. The drive unit is pivotable with respect to the stern bracket about a tilt axis. The watercraft includes a transom. The stern bracket includes a support member for fixing the drive unit to the transom and a water deflector. The water deflector includes a mounting bracket attached to the support member. A deflection plate, connected to the mounting bracket, is disposed at a vertical position lower than the tilt axis. The deflection plate extends between the transom and the drive unit when the drive unit is mounted to the stern bracket and the stern bracket is mounted to the transom. A left deflection wing is connected to at least one of the deflection plate and the mounting bracket. The left deflection wing extends downward and laterally outward from the at least one of the deflection plate and the mounting bracket. A right deflection wing is connected to at least one of the deflection plate and the mounting bracket. The right deflection wing extends downward and laterally outward from the at least one of the deflection plate and the mounting bracket.

In a further aspect, the deflection plate extends downward and rearward from a front edge thereof proximate the transom to a rear edge thereof.

In a further aspect, at least a portion of a rear edge of the deflection plate is recessed for receiving a front surface of an outboard engine mounted to the watercraft by the stern bracket. In some embodiments, the recessed portion is curved.

In another aspect, the deflection plate is fastened to the support member.

In an additional aspect, an inner surface of the left deflection wing extends at a wing angle with respect to a lower surface of the deflection plate, and the wing angle is less than 150°. In some embodiments, the wing angle is between 115° and 135°. In some embodiments, the wing angle is 125°.

In a further aspect, each of the left and right deflection wings includes a front edge, and at least a portion of the front edge of each deflection wings is generally aligned with a front edge of the deflection plate in a longitudinal direction.

In another aspect, each of the left and right deflection wings includes a rear edge, and at least a portion of the rear edge of each deflection wings is generally aligned with a rear edge of the deflection plate in a longitudinal direction.

In yet another aspect, each of the left and right deflection wings comprises a front edge, a rear edge, and a bottom edge. For each deflection wing, the bottom edge slopes downwards and rearwards from the front edge to the rear edge of the deflection wing.

In an additional aspect, the mounting bracket includes a left mounting bracket and a right mounting bracket. The left mounting bracket is attached to a left portion of the support member. The left deflection wing is connected to at least one of the deflection plate and the left mounting bracket. The right mounting bracket is attached to a right portion of the support member. The right deflection wing is connected to at least one of the deflection plate and the right mounting bracket. In some embodiments, the deflection plate has a left lateral edge and a right lateral edge, each of the left and right lateral edges being received in a channel formed in a corresponding one of the left and right mounting brackets.

In an additional aspect, the water deflector also includes a sacrificial anode extending laterally between the left and right portions of the support members. The sacrificial anode is attached to at least one of the left and right mounting brackets; and the deflection plate. In an additional aspect, the deflection plate includes a left tab and a right tab extending upwards respectively from a left lateral edge and a right lateral edge of the deflection plate. The left and right tabs are disposed laterally between the left and right portions of the support members. A shaft is connected between the left and right tabs. The shaft is made of a material that is non-corrodible in salt water. The sacrificial anode being mounted on the shaft.

In a further aspect, an upper portion of the left deflection wing is attached to a lower portion of the left mounting bracket, and an upper portion of the right deflection wing is attached to a lower portion of the right mounting bracket.

In an additional aspect, the left mounting bracket and the left deflection wing are integral, and the right mounting bracket and the right deflection wing are integral.

In an additional aspect, an outer surface of the integral left mounting bracket and left deflection plate is facing away from the integral right mounting bracket and the right deflection wing. The outer surface includes a plurality of left outer ribs formed in at least one of the upper portion of the left deflection wing and the lower portion of the left mounting bracket. An outer surface of the integral right mounting bracket and right deflection wing facing away from the integral left mounting bracket and left deflection wing includes a plurality of right outer ribs formed in at least one of the upper portion of the right deflection wing and the lower portion of the right mounting bracket.

In another aspect, an inner surface of each one of the left and right mounting brackets facing toward the other one of the left and right mounting brackets includes a plurality of inner ribs.

In yet another aspect, for each mounting bracket, a surface of the support member abuts one of the plurality of inner ribs.

In another aspect, the present provides a watercraft including a transom, a drive unit and a bracket assembly. The drive unit includes a driveshaft defining a driveshaft axis, a propeller shaft operatively connected to the driveshaft, and a propeller connected to the propeller shaft. The bracket assembly includes a swivel bracket and a stern bracket. The swivel bracket is connected to the drive unit. The drive unit is pivotable with respect to the swivel bracket about a steering axis generally parallel to the driveshaft axis. The swivel bracket is pivotable with respect to the stern bracket about a tilt axis perpendicular to the steering axis and the propeller shaft. The stern bracket includes a support member for fixing a drive unit to the transom and a water deflector. The water deflector includes a mounting bracket attached to at least one of the support member and the transom. A deflection plate, connected to the mounting bracket, is disposed at a vertical position lower than the tilt axis. The deflection plate extends between the transom and the drive unit. A left deflection wing is connected to at least one of the deflection plate and the mounting bracket. The left deflection wing extends downward and laterally outward from the at least one of the deflection plate and the mounting bracket. A right deflection wing is connected to at least one of the deflection plate and the mounting bracket. The right deflection wing extends downward and laterally outward from the at least one of the deflection plate and the mounting bracket.

In another aspect, the deflection plate extends downward and rearward from a front edge thereof proximate the transom to a rear edge thereof.

In yet another aspect, an inner surface of the left deflection wing extends at a wing angle with respect to a lower surface of the deflection plate, and the wing angle is less than 150°.

In an additional aspect, the mounting bracket comprises a left mounting bracket and a right mounting bracket. The left mounting bracket is attached to a left portion of the support member. The left deflection wing is connected to at least one of the deflection plate and the left mounting bracket. The right mounting bracket is attached to a right portion of the support member. The right deflection wing is connected to at least one of the deflection plate and the right mounting bracket.

For purposes of this application, terms related to spatial orientation such as forward, rearward, left, right, vertical, and horizontal are as they would normally be understood by a driver of a boat in a normal driving position with a marine outboard engine mounted to a transom of the boat. The definitions provided herein take precedence over explanations of these terms that may be found in any one of the documents incorporated herein by reference.

Embodiments of the present invention each have at least one of the above-mentioned aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
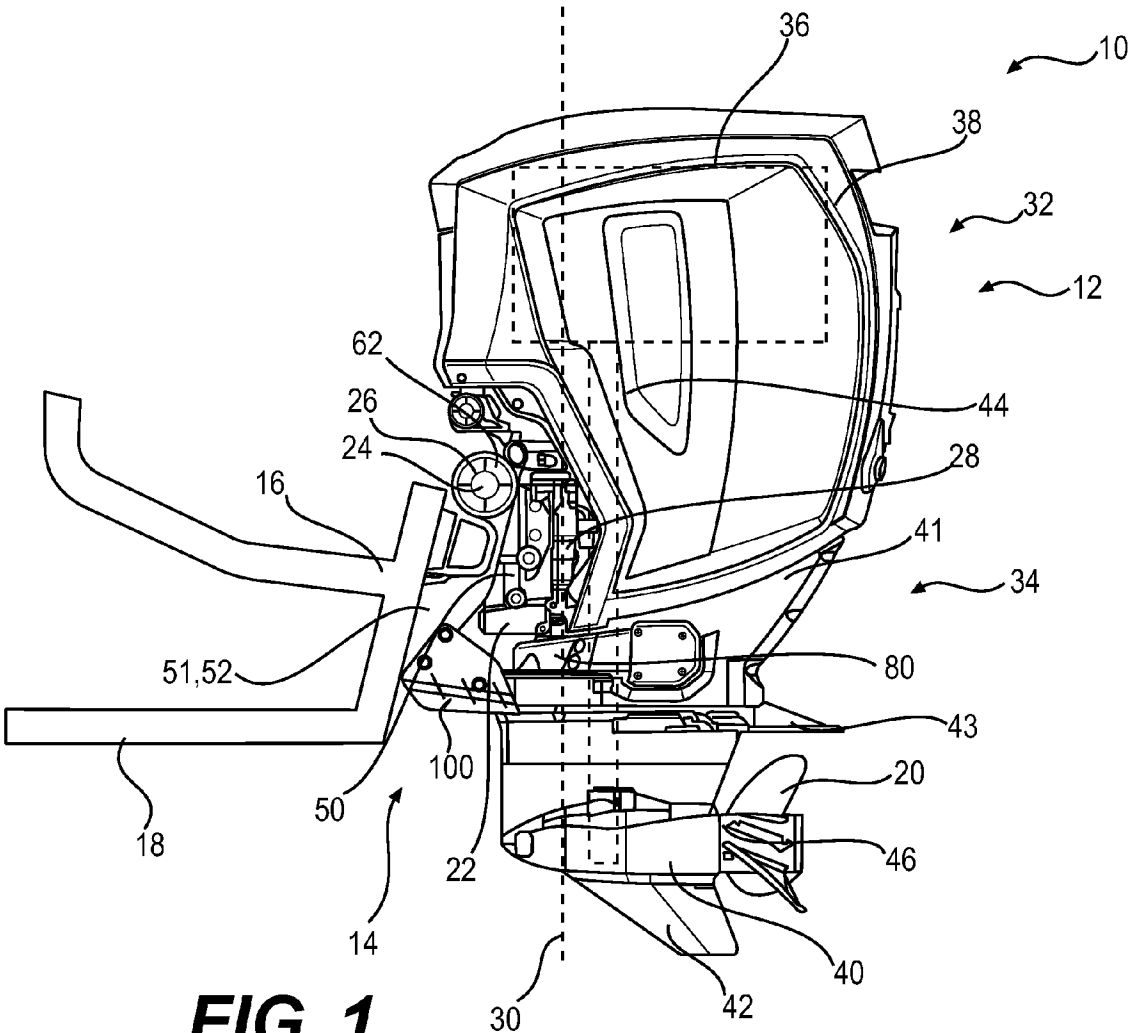
FIG. 1 is a left side elevation view of a marine outboard engine mounted in an upright position to a transom of a watercraft.
Figure 2:
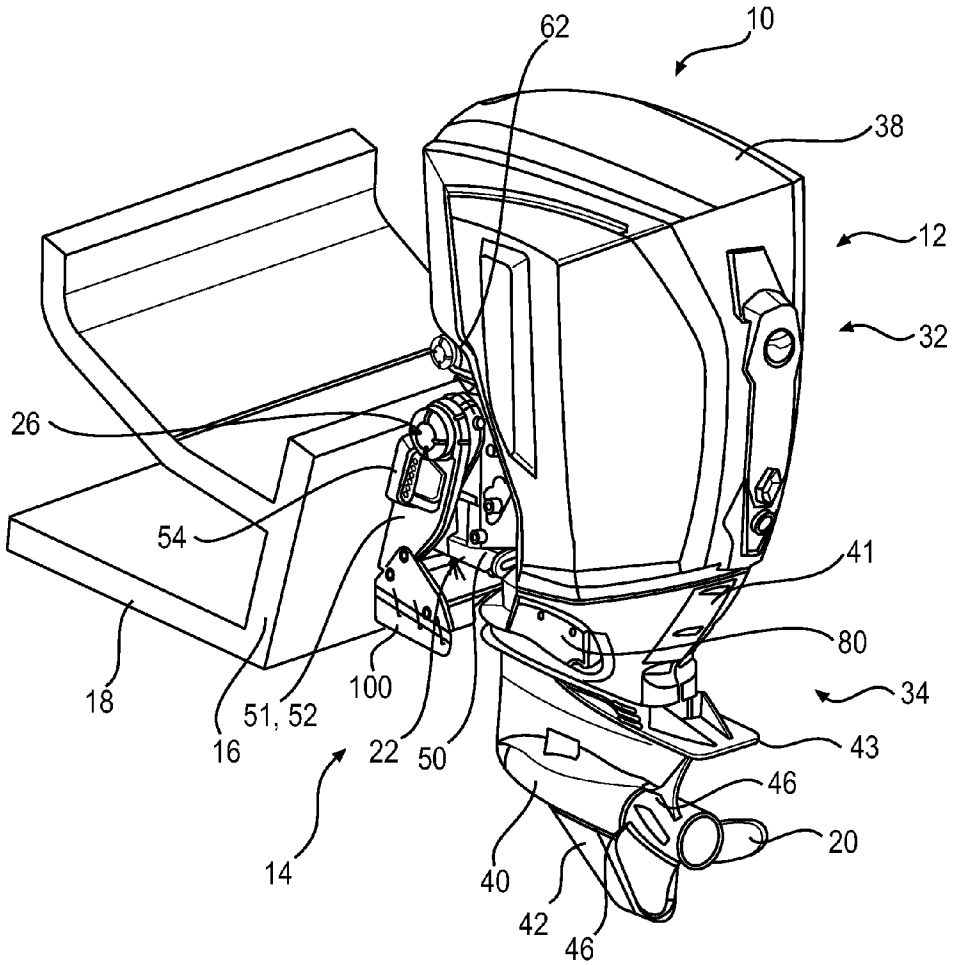
FIG. 2 is a perspective view taken from a rear, left side of the outboard engine and transom of FIG. 1.

With reference to FIGS. 1 and 2, a marine outboard engine 10, shown in the upright position, includes a drive unit 12 and a bracket assembly 14. The bracket assembly 14 supports the drive unit 12 on a transom 16 of a hull 18 of an associated watercraft (not shown) such that a propeller 20 of the drive unit 12 is in a submerged position with the watercraft resting relative to a surface of a body of water.

The drive unit 12 includes an upper portion 32 and a lower portion 34. The upper portion 32 includes an engine 36 (schematically shown in dotted lines in FIG. 1) surrounded and protected by a cowling 38. The engine 36 housed within the cowling 38 is an internal combustion engine, such as a two-stroke or four-stroke engine, having cylinders extending horizontally. It is contemplated that other types of engines could be used and that the cylinders could be oriented differently.

The lower portion 34 includes the gear case assembly 40, which includes the propeller 20 and the skeg portion 42, and the midsection 41 which extends from the upper portion 32 to the gear case assembly 40. An anti-ventilation plate 43 extends rearwards from the lower section 34 above the propeller 20.

The engine 36 is coupled to a driveshaft 44 (schematically shown in dotted lines in FIG. 1). When the drive unit 12 is in the upright position as shown in FIGS. 1 and 2, the driveshaft 44 is oriented vertically. It is contemplated that the driveshaft 44 could be oriented differently relative to the engine 34. The driveshaft 44 is coupled to a drive mechanism (not shown), which includes a transmission (not shown) and the propeller 20 mounted on a propeller shaft 46. In FIG. 1, the propeller shaft 46 is perpendicular to the driveshaft 44, however it is contemplated that it could be at other angles. The driveshaft 44 and the drive mechanism transfer the power of the engine 36 to the propeller 20 mounted on the rear side of the gear case assembly 40 of the drive unit 12. It is contemplated that the propulsion system of the outboard engine 10 could alternatively include a jet propulsion device, turbine or other known propelling device. It is further contemplated that the bladed rotor could alternatively be an impeller.

Other known components of an engine assembly are included within the cowling 38, such as a starter motor, an alternator and the exhaust system. As it is believed that these components would be readily recognized by one of ordinary skill in the art, further explanation and description of these components will not be provided herein.

The drive unit 12 can be trimmed up or down relative to the hull 18 by linear actuators 22 of the bracket assembly 14 about a tilt/trim axis 24 extending generally horizontally. The drive unit 12 can also be tilted up or down relative to the hull 18 by a rotary actuator 26 of the bracket assembly 14 about the tilt/trim axis 24. The drive unit 12 can also be steered left or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIGS. 1 and 2, the steering axis 30 extends generally vertically. The actuators 22, 26 and 28 are hydraulic actuators.

With reference to FIGS. 1 to 4, the bracket assembly 14 includes a swivel bracket 50 pivotally connected to a stern bracket 51.

The stern bracket 51 mounts the drive unit 12 on the transom 16. The stern bracket 51 comprises a support member 52 which is formed of left and right spaced apart vertical support member portions 52*a*, 52*b* connected by a central portion 53. Each vertical support member portion 52*a*, 52*b* includes a plurality of holes 54 and a slot 56 adapted to receive fasteners (not shown) used to fasten the bracket assembly 14 to the transom 16 of the watercraft. By providing many holes 54 and the slots 56, the vertical position of the stern bracket 51, and therefore the bracket assembly 14, relative to the transom 16 can be adjusted.

The rotary actuator 26, disposed generally horizontally in an upper portion of the swivel bracket 50, pivots the swivel bracket 50 about the tilt/trim axis 24 toward/away from the stern bracket 51 (i.e. tilt down/up). The upper end of the stern bracket 51 has splined openings 61 (FIG. 5) receiving a corresponding set of splined ends of a central shaft (not shown) of the rotary actuator 26 so that the stern bracket 51 is rotationally fixed relative to the central shaft of the rotary actuator 26. Anchoring end portions 62 are fastened to the sides of the stern bracket 51 over the splined openings 61 and the splined ends of the rotary actuator 26, thus preventing lateral displacement of the swivel bracket 50 relative to the stern bracket 51. It is contemplated that the rotary actuator 26 could be replaced by a linear hydraulic actuator connected between the swivel bracket 50 and the stern bracket 51.

A locking arm 63 (FIG. 3), pivotally connected to the swivel bracket 50 maintains the swivel bracket 50 in a half-tilt position, which is a position of the swivel bracket 50 typically used when the outboard engine is in storage or on a trailer.

The linear actuators 22 are located in a lower end of the swivel bracket 50. The linear actuators 22, extending generally longitudinally, serve to pivot the swivel bracket 50 toward or away from the stern bracket 51 (i.e. trim down/up) about the tilt/trim axis 24. The movement achieved by the linear actuators 22 is known as trim as they allow for precise angular adjustment of the swivel bracket 50 relative to the stern bracket 51 at a slower angular speed than that provided by the rotary actuator 26.

The rotary actuator 28 is disposed centrally along the swivel bracket 50, rearward of the linear actuators 22. The rotary actuator 28 pivots the drive unit 12 about the steering axis 30. A central shaft (not shown) of the rotary actuator 28 is coaxial with the steering axis 30. Splined ends (not shown) of the central shaft are received in complementary splined openings of upper and lower pivot brackets 78, 80. The generally U-shaped upper and lower drive unit pivot brackets 78, 80 are fastened to the drive unit 12 so as to support the drive unit 12 onto the bracket assembly 14. As a result, the drive unit 12 and the central shaft of the rotary actuator 28 are rotationally fixed relative to each other. Anchoring end portions 82 fastened to the pivot brackets 78, 80 over the splined openings prevent displacement of the drive unit 12 along the steering axis 30. It is contemplated that the rotary actuator 28 could be replaced by a linear hydraulic actuator connected between the swivel bracket 50 and the drive unit 12.

U.S. Pat. No. 7,736,206 B1, issued Jun. 15, 2010, included herein by reference, provides additional details regarding rotary actuators similar in construction to the rotary actuators 26 and 28.

The stern bracket 51 includes a water deflector 100. The water deflector 100 is positioned below the stern bracket 51 although it is contemplated that the water deflector 100 could also be positioned above the stern bracket 51. The water deflector 100 is spaced from the bottom of the hull 18. The water deflector 100 extends between the transom 16 and the lower pivot bracket 80 of the drive unit 12 in an upright in the position as shown in FIGS. 1 to 4.

Depending on a number of factors, including but not limited to the shape of a boat's hull or transom, and the water conditions at the time of use, water can splash upwards between the transom 16 and the outboard engine 10, especially during acceleration of the boat from rest. The water deflector 100 can help prevent water from splashing upwards to the upper section 32 of the drive unit 12 or into the watercraft. The water deflector 100 can deflect water rearwards and downwards.

The water deflector 100 will be described in further detail now with reference to FIGS. 5 to 11.

The water deflector 100 includes a deflection plate 102, and left and right deflection wings 104. The water deflector 100 is attached to the stern bracket 51 by a mounting bracket 106. It is contemplated that the water defector could be attached to the transom 16 instead of, or in addition to, being attached to the stern bracket 51 as in the illustrated embodiment. In the embodiment illustrated, a left mounting bracket 106 attached the deflection plate 102 to the left support member portion 52*a*, and a right mounting bracket 106 attached the deflection plate 102 to the right support member portion 52*b*. It is however contemplated that the deflection plate 102 could be attached to the support members 52*a*, 52*b* by a single mounting bracket 106.

The deflection plate 102 extends below the stern bracket 51. In the illustrated embodiment, the deflection plate 102 is planar but it is also contemplated that the deflection plate 102 could not be planar. The deflection plate 102 extends between a front edge 110, a rear edge 112, and two lateral edges 114. The deflection plate 102 is mounted to the stern bracket 51 such that it slopes downward from the front edge 110 to the rear edge 112, i.e. the rear edge 112 is disposed lower than the front edge 110. It is contemplated that only a portion of the deflection plate 102 between the front and rear edges 110, 112 could be angled. It is contemplated that the deflection plate 102 could extend at an angle different from that shown.

The deflection plate 102 is made of sheet metal but it is contemplated that the deflection plate 102 could be made of any suitable material.

The straight front edge 110 of the deflection plate 102 abuts the transom 16 at a position just below the lower edge of the stern bracket 51. It is desirable to make the space between the deflection plate 102 and the transom 16 as small as possible in order to minimize water splashing upwards through this space. When the drive unit 12 is in the fully trimmed in position, i.e. when the gear case 40 is at its closest to the transom 16, the rear edge 112 of the deflection plate 102 is proximate and below the front edge of the lower pivot bracket 80. The rear edge 112 has a curved, recessed, central portion 113 adapted to fit around the outer surface of the gear case 40 and midsection 41 when in the fully trimmed in position. It is contemplated that the deflection plate 102 could extend from a different location than shown. For example, the front edge 110 could be positioned along the stern bracket 51 at a higher position than as shown herein. Alternatively, the front edge 110 could be positioned lower on the transom 16 either by providing a longer stern bracket 51 or mounting bracket 106 that extends farther down the transom 16. It is also contemplated that the deflection plate 102 could extend towards a different location of the drive unit 12 than as shown herein, that is to say higher or lower along the front side of the drive unit 12. In general, the deflection plate 102 extends below the tilt/trim axis 24. The deflection plate 102 could extend horizontally or angled downwards towards the rear as shown herein. The angle at which the deflection plate 102 extends and the position of the front and rear edges 110, 112 are determined based on the particular configuration of the stern bracket 51, the swivel bracket 50, the drive unit 12 and the transom 16.

The left lateral edge 114 of the deflection plate 102 abuts the left mounting bracket 106. The right lateral edge 114 abuts the right mounting bracket 106. At the forward extremity of the left and right lateral edges 114, the deflection plate 102 is turned up to form a left tab 116 and a tab right 116. Each tab 116 has an opening 117.

Figure 3:
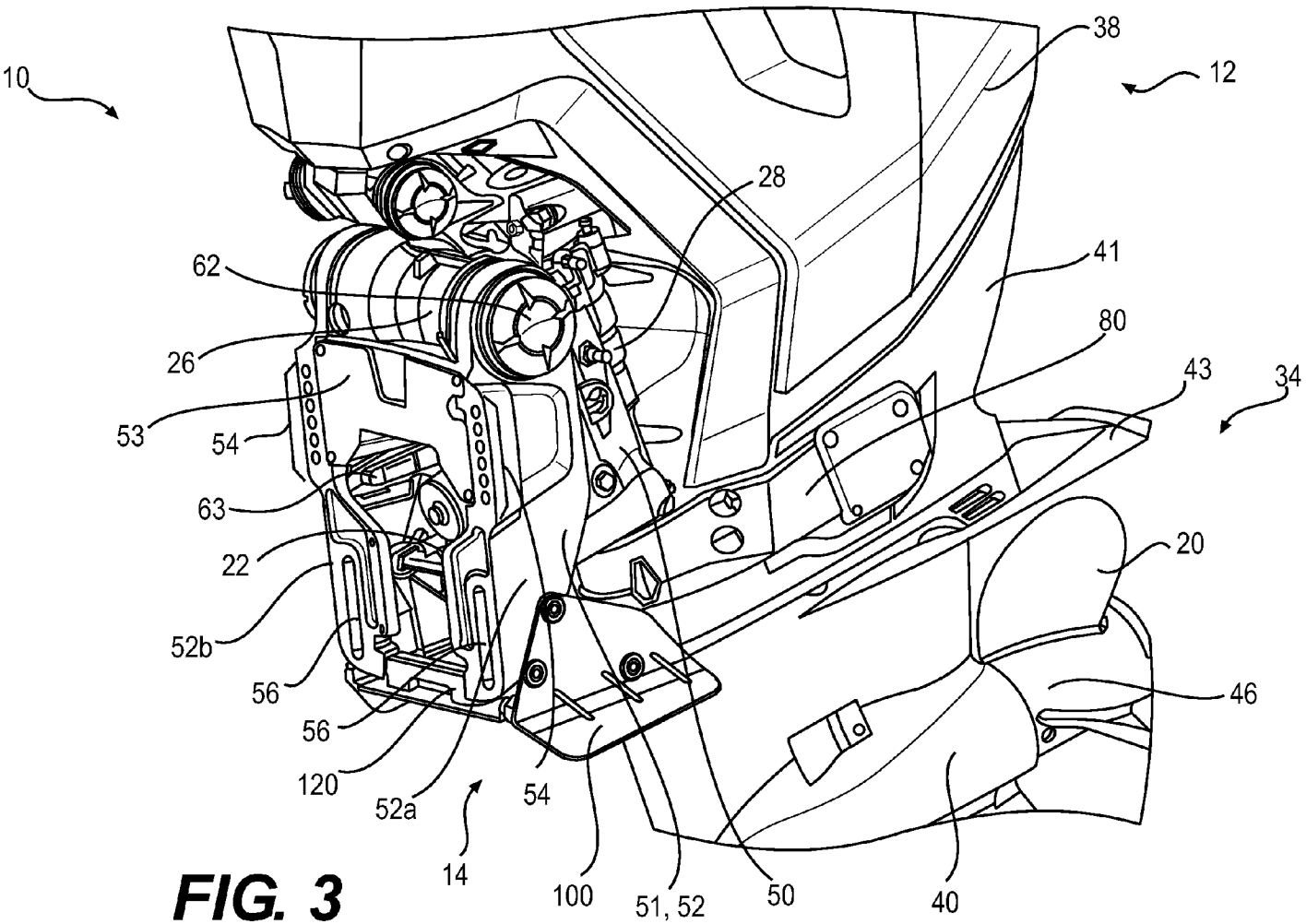
FIG. 3 is a close-up perspective view taken from a front, left side of the outboard engine of FIG. 1 showing a bracket assembly and lower portion of a drive unit of the outboard engine of FIG. 1.
Figure 4:
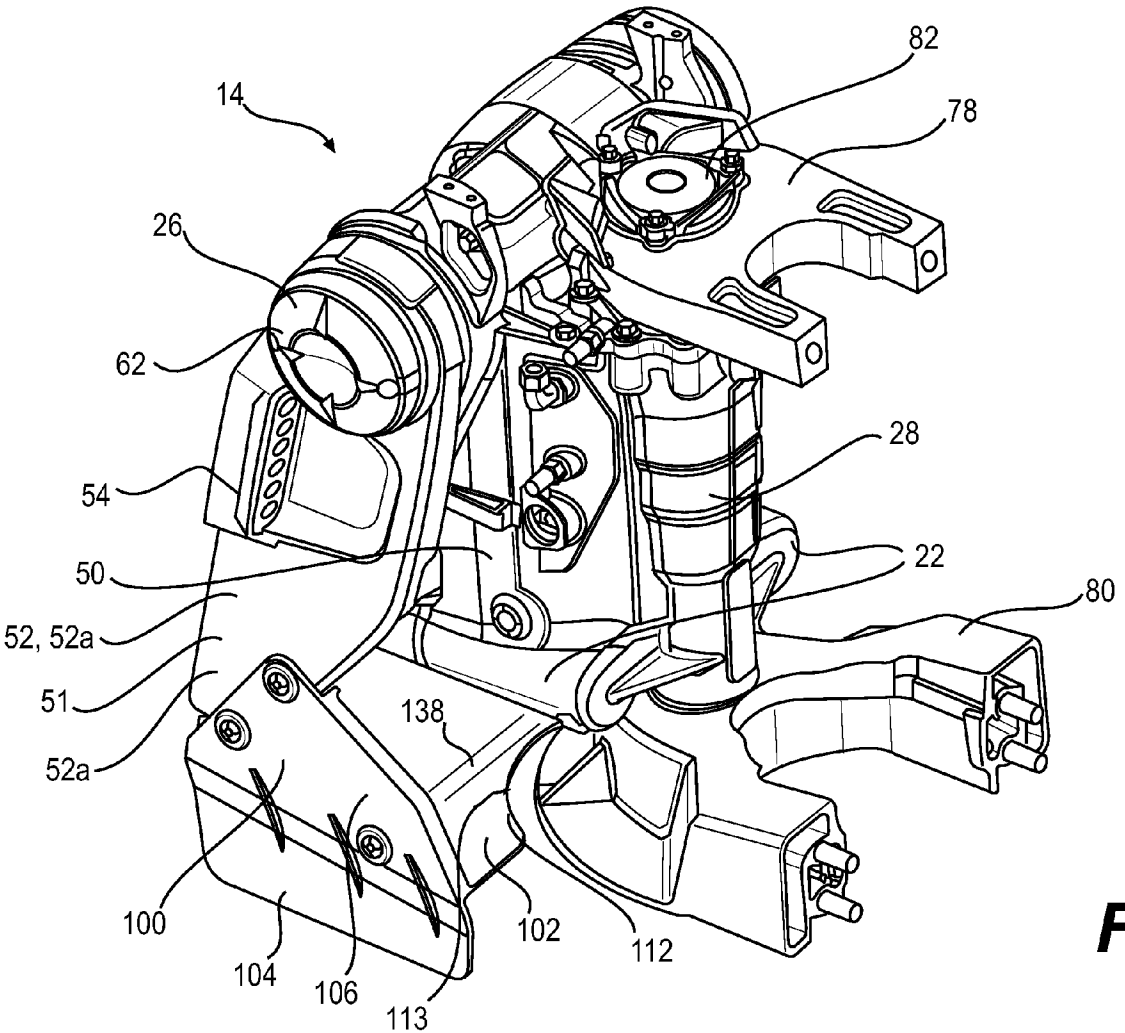
FIG. 4 is a perspective view taken from a top, rear and left side of the bracket assembly of the outboard engine of FIG. 1.
Figure 5:
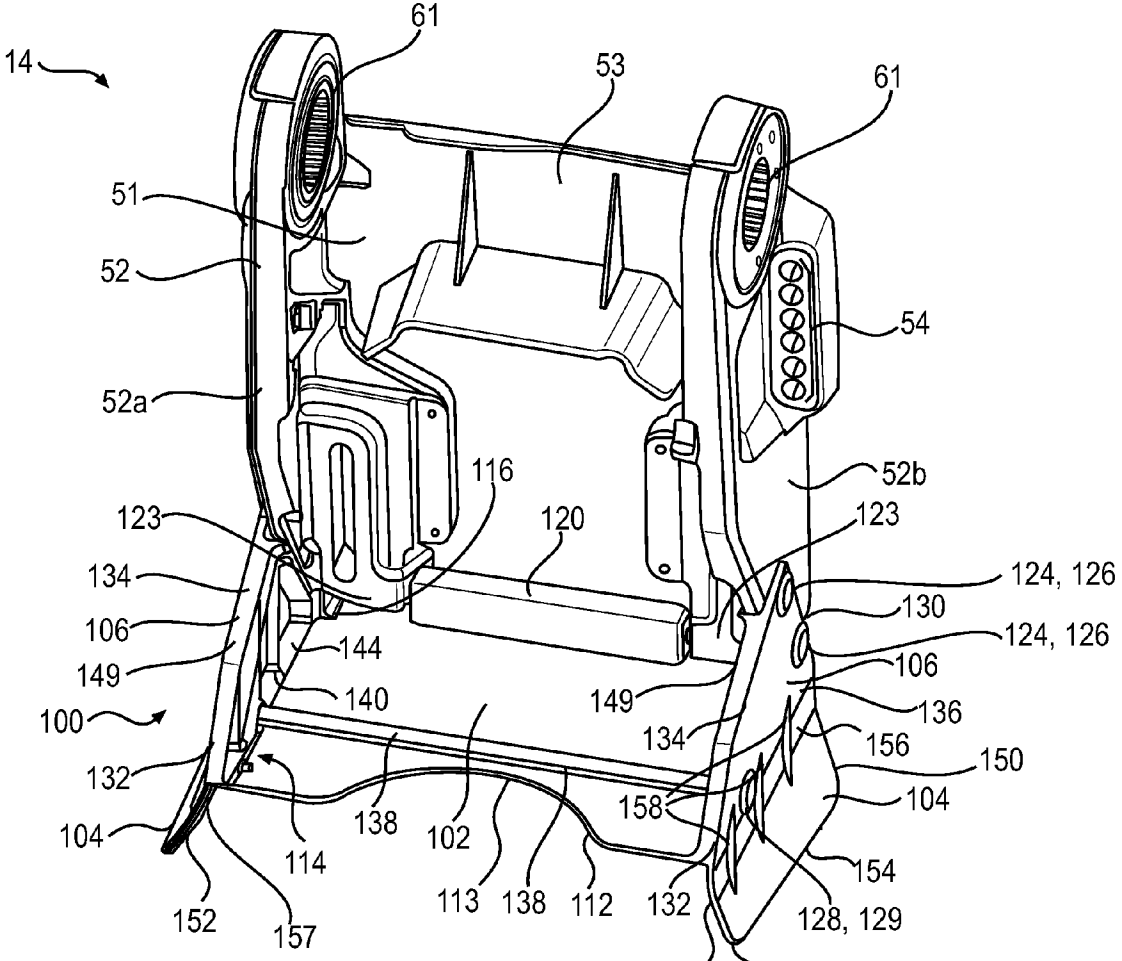
FIG. 5 is a perspective view taken from a top, rear and right side of a stern bracket of the bracket assembly of FIG. 4.
Figure 6:
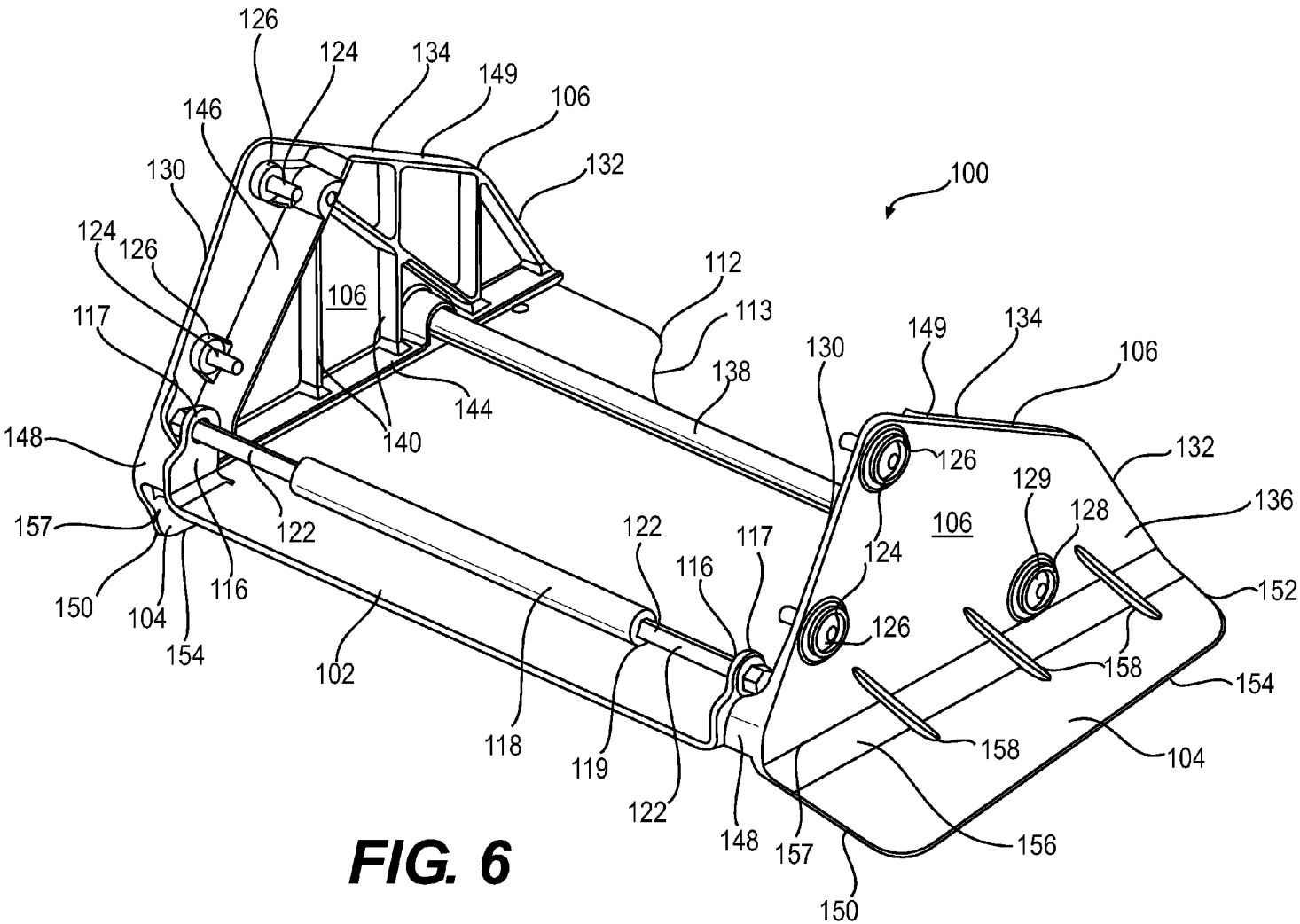
FIG. 6 is a perspective view taken from a top, front and left side of a water deflector of the stern bracket of FIG. 5.
Figure 7:
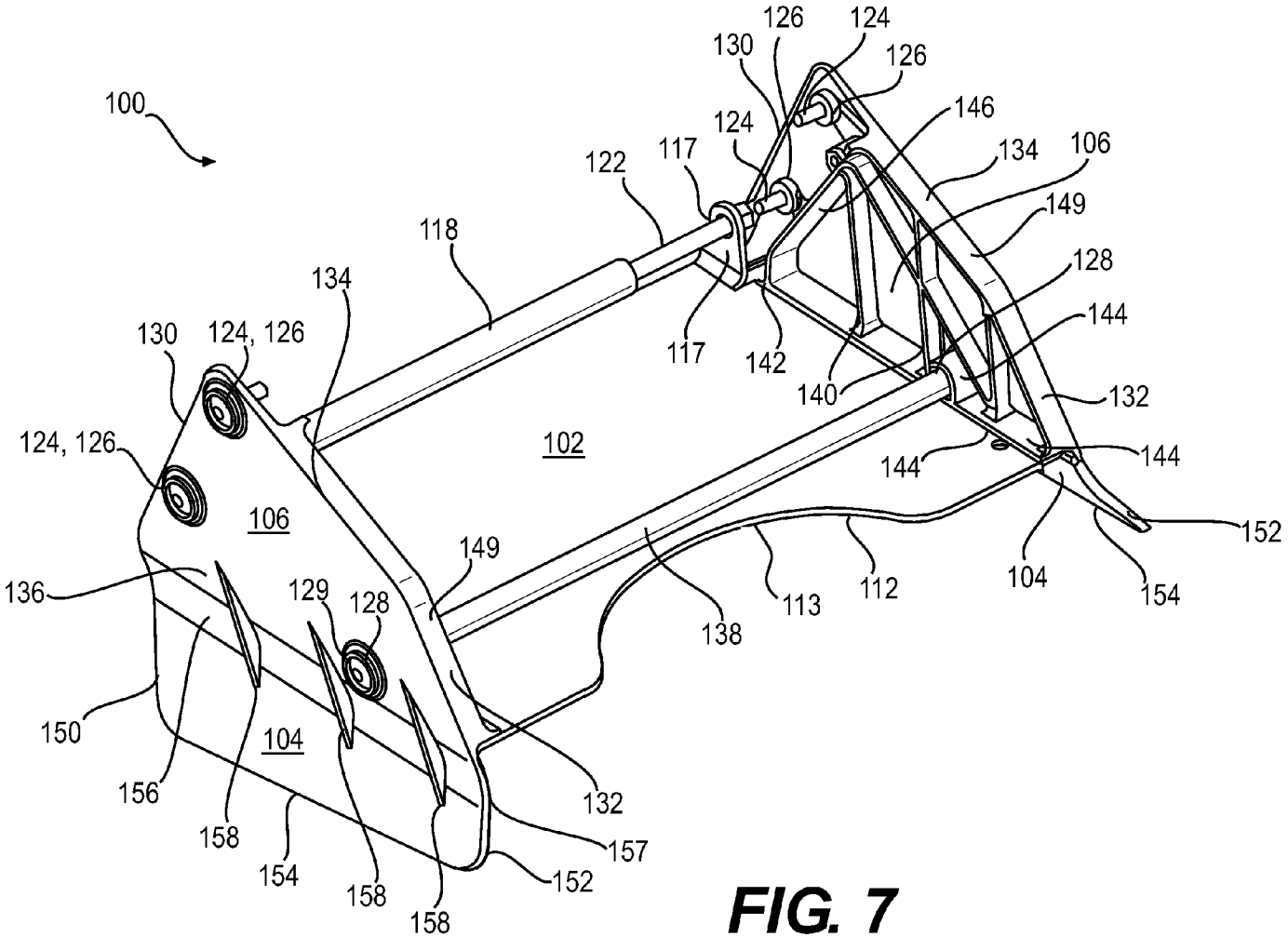
FIG. 7 is a perspective view taken from a top, rear and left side of the water deflector of FIG. 6.
Figure 8:
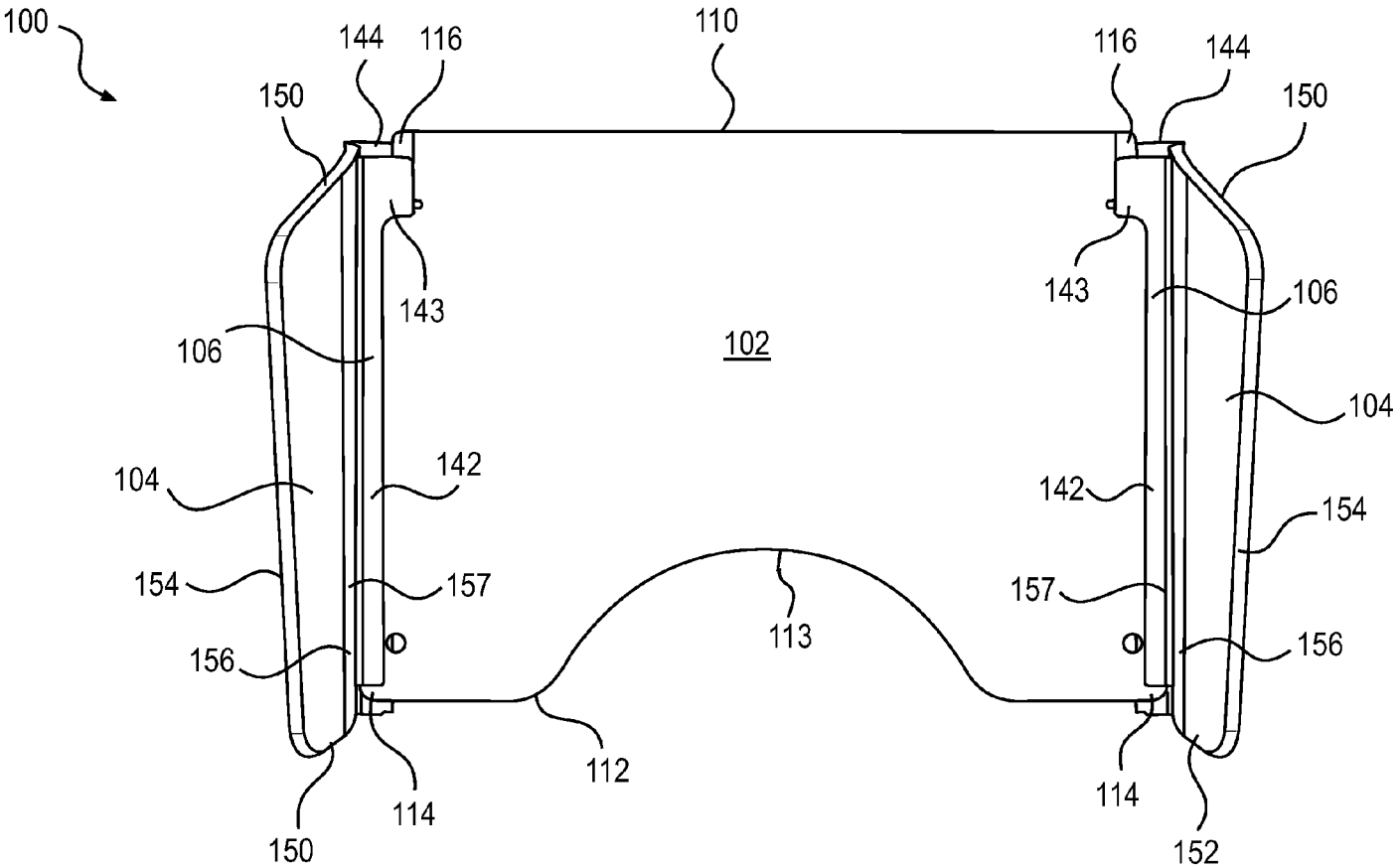
FIG. 8 is a bottom plan view of the water deflector of FIG. 6.
Figure 11:
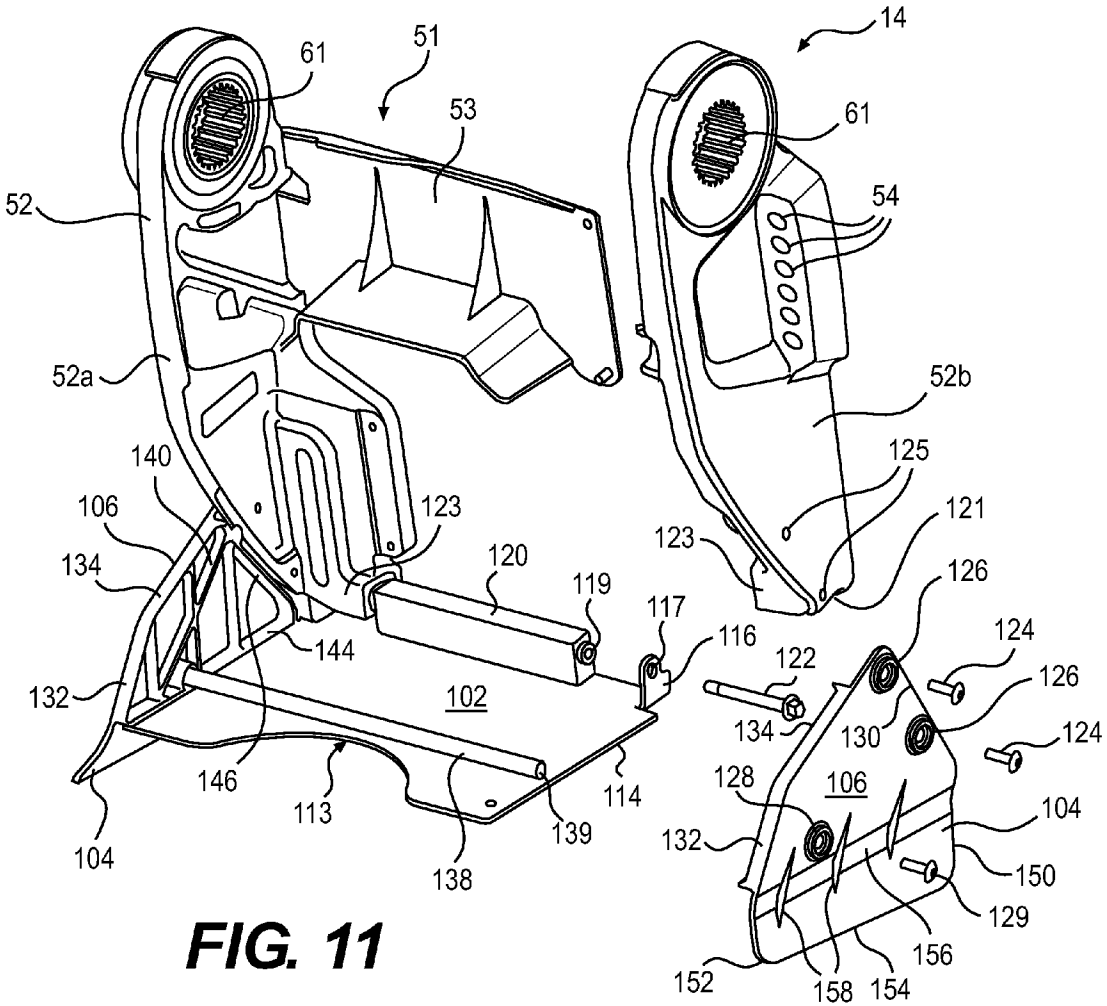
FIG. 11 a partially exploded perspective view taken from a top, rear and right side of the stern bracket of FIG. 5.

As can be seen in FIGS. 3, 5 and 11, a sacrificial anode 120 is mounted between the left and right support members 52*a* and 52*b*. The sacrificial anode 120 is made of zinc and used to prevent corrosion to the outboard engine assembly 10, as is known in the art and will not be discussed in further detail herein. The sacrificial anode 120 is located between a lower portion 123 of the left support member portion 52*a* that is disposed just laterally inward of the left tab 116, and a lower portion 123 of the right support member portion 52*b* that is disposed just laterally inward of the right tab 116. The sacrificial anode 120 is cast around a non-corrodible shaft 118 (seen in FIGS. 6, 7 and 11) which extends laterally therethrough. The shaft 118, having a threaded opening 119 at each end, is held between the lower portions 123 of the stern bracket support members 52*a*, 52*b*. The lower portion 123 of the right support member portion 52*b* has an opening 121 (shown in FIG. 11) aligned with the right opening 119 of the shaft 118 and the right tab opening 117. A right bolt 122 (FIGS. 6, 7 and 11) is inserted through the aligned openings of the right tab 116, right support member portion 52*b* and the right side of the shaft 118. A left bolt 122 is inserted through corresponding openings 117, 121 of the left tab 116, and left support member portion 52*a* into the left opening 119 of shaft 118. The bolts 122 thus fasten the deflection plate 102 to the stern bracket 51 and shaft 118. The bolts 122 are concealed when the mounting brackets 106 are mounted over the stern bracket support members 52*a*, 52*b* and the deflection plate 102. The shaft 118 and the bolts 122 are electrically conductive, thereby bringing the metal deflection plate 102 in electrical contact with the anode 120.

It is contemplated that the sacrificial anode 120 could have a different shape and structure than as shown. For example, the sacrificial anode 120 could have a circular cross-section rather than a square cross-section, or the sacrificial anode 120 could be formed as a plurality of rings. It is contemplated that the shaft 118 and the sacrificial zinc anode 120 could be omitted.

The left mounting bracket 106 extends upward from the left lateral edge 114 of the deflection plate 102 and abuts a left side surface of the left support member portion 52*a*. The right mounting bracket 106 extends upward from the right lateral edge 114 of the deflection plate 102 and abuts a right side surface of the right support member 52*b*. The left and right mounting brackets 106 are mirror images of each other, and therefore only the left mounting bracket 106 will be described hereinafter. It is contemplated that the mounting brackets 106 could also be identical.

The left mounting bracket 106 has a front edge 130, a rear edge 132, an upper edge 134 and a lower portion 136 that extends generally along the left edge 114 of the deflection plate 102. The front edge 130 extends upward and rearward from the front edge 110 of the deflection plate 102. The rear edge 132 extends upward and forward from the rear edge 112 of the deflection plate 102. The upper edge 134 of the mounting bracket 106 extends rearward and downward from the front edge 130 thereof to the rear edge 132 thereof. The left lateral edge 114 of the deflection plate 102 is connected to a right side surface of the lower portion 136 of the mounting bracket 106. The lower portion 136 of each mounting bracket 106 is also attached to the corresponding deflection wing 104. It is contemplated that the shape of the mounting brackets 106 could be different than as shown.

Two through-holes 126 are formed near the front edge 130 of the mounting bracket 106—a first hole 126 is near an upper end thereof and a second hole 126 is near a lower end thereof. The holes 126 are aligned with two corresponding threaded holes 125 (FIG. 11) defined in the right surface of the left support member 52*a*. The left mounting bracket 106 is fastened to the right support member portion 52*b* by means of bolts 124 inserted through each hole 126 and into the corresponding hole 125.

The left mounting bracket 106 has a third through-hole 128 formed in the lower portion 136 near the rear edge 132. The through-hole 128 is used to fasten the mounting brackets 106 to each other by means of a shaft 138 and to thereby fasten the rear portion of deflection plate 102 therebetween. The shaft 138 has a left end and a right end. A threaded hole 139 extends into the left end of the shaft 138, which is placed laterally inward of the left mounting bracket 106 with the through-hole 128 aligned with the threaded hole 139 of the shaft 138. A bolt 129, inserted through the hole 128 into the threaded hole 139 of the shaft 138, fastens the left mounting bracket 106 to the shaft 138. The right end of the shaft 138 is similarly fastened to the right mounting bracket 106 to fasten the mounting brackets 106 to each other and the deflection plate 102 therebetween.

Ribs 140, 142, 143, 144, 146, 148, 149 projecting inwardly from the right side surface of the left mounting bracket 106 to provide reinforcement and aid in alignment of the various elements for assembly of the water deflector 100 with the support members 52*a*, 52*b*. Ribs 140 in the middle portion of the mounting bracket 106 provide reinforcement. Two parallel ribs 142, 144 extend along the lower portion 136 of the mounting bracket 106, forming a channel therebetween. The left lateral edge 114 of the deflection plate 102 is received in the channel formed by the ribs 142, 144. The lower rib 142 extends from the front edge 130 to the rear edge 132 of the mounting bracket 106. A front portion 143 of the lower rib 142 projects laterally inwards to extend underneath the left tab 116 of the deflection plate 102. The upper rib 144 extends forward from the rear edge 132 to connect to a forward rib 146. The forward rib 146 is spaced from the front edge 130 with the holes 126 being formed between forward rib 146 and the front edge 130. The forward rib 146 abuts a rear edge of the left support member portion 52*a*. A rib 148 extends laterally inward from the lower end of the front edge 130 toward the tab 116 of the deflection plate 102. The rib 144 curves around the hole 128 and the end of the shaft 138. A rib 149, connected to the forward rib 146, extends along the upper edge 134 and the rear edge 132 of the mounting bracket 106.

It is contemplated that one or more of the ribs 140, 142, 143, 144, 146, 148, 149 could be omitted and that additional ribs could be provided.

As mentioned above, the left deflection wing 104 is attached to the lower portion 136 of the left mounting bracket 106 and the right deflection wing 104 is attached to the lower portion 136 of the right mounting bracket 106.

The deflection plate 102 deflects upwardly splashing water downward and rearward away from the stern bracket 51. The deflection wings 104 further direct the water (the deflected water and the upwardly splashing water) laterally outward away from the deflection plate 102, and downward and rearward.

The left and right deflection wings 104 are mirror images of each other, and as such only the left deflection wing 104 will be described in detail herein.

Figure 9:
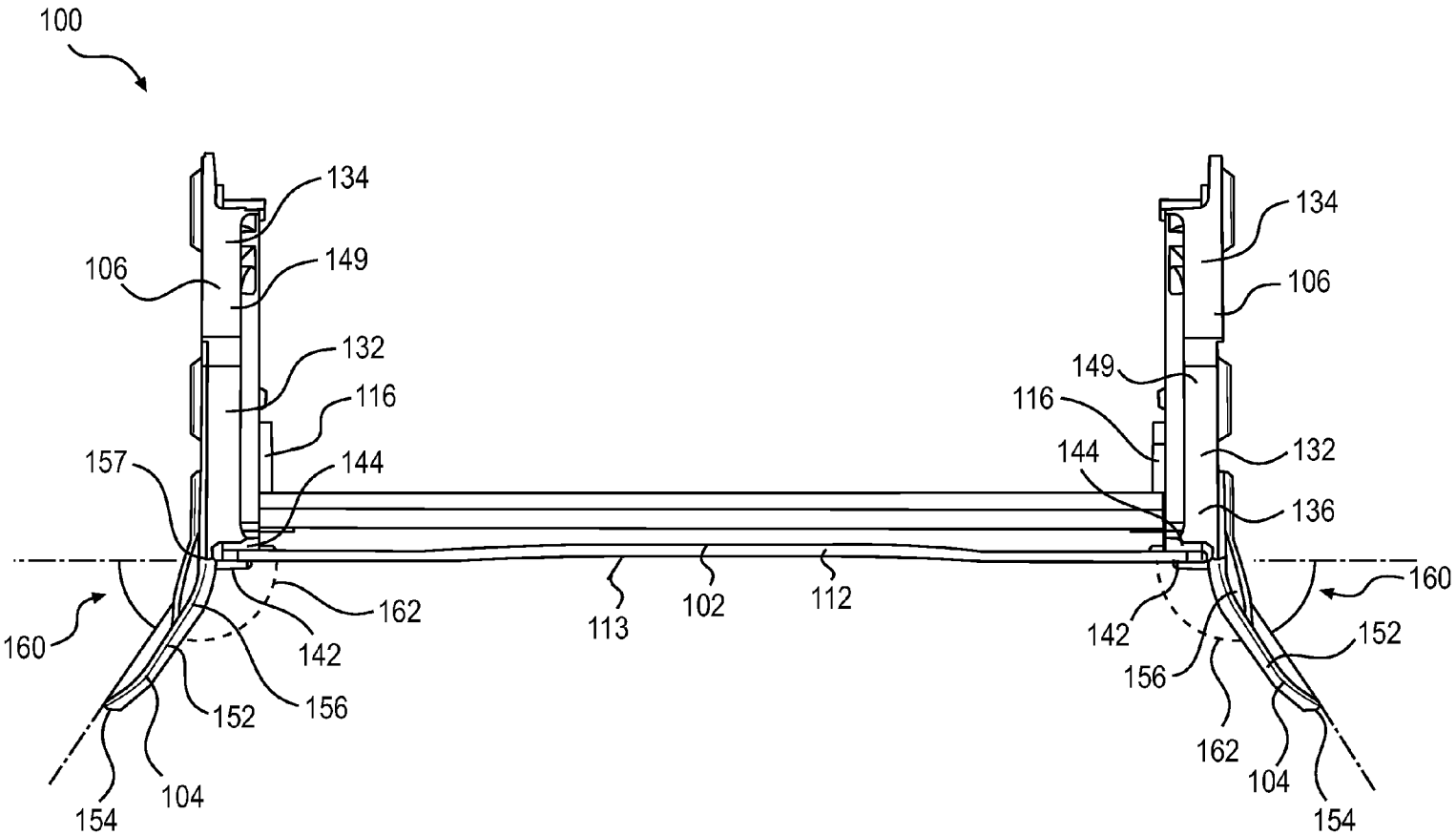
FIG. 9 is a rear elevation view of the water deflector of FIG. 6.
Figure 10:
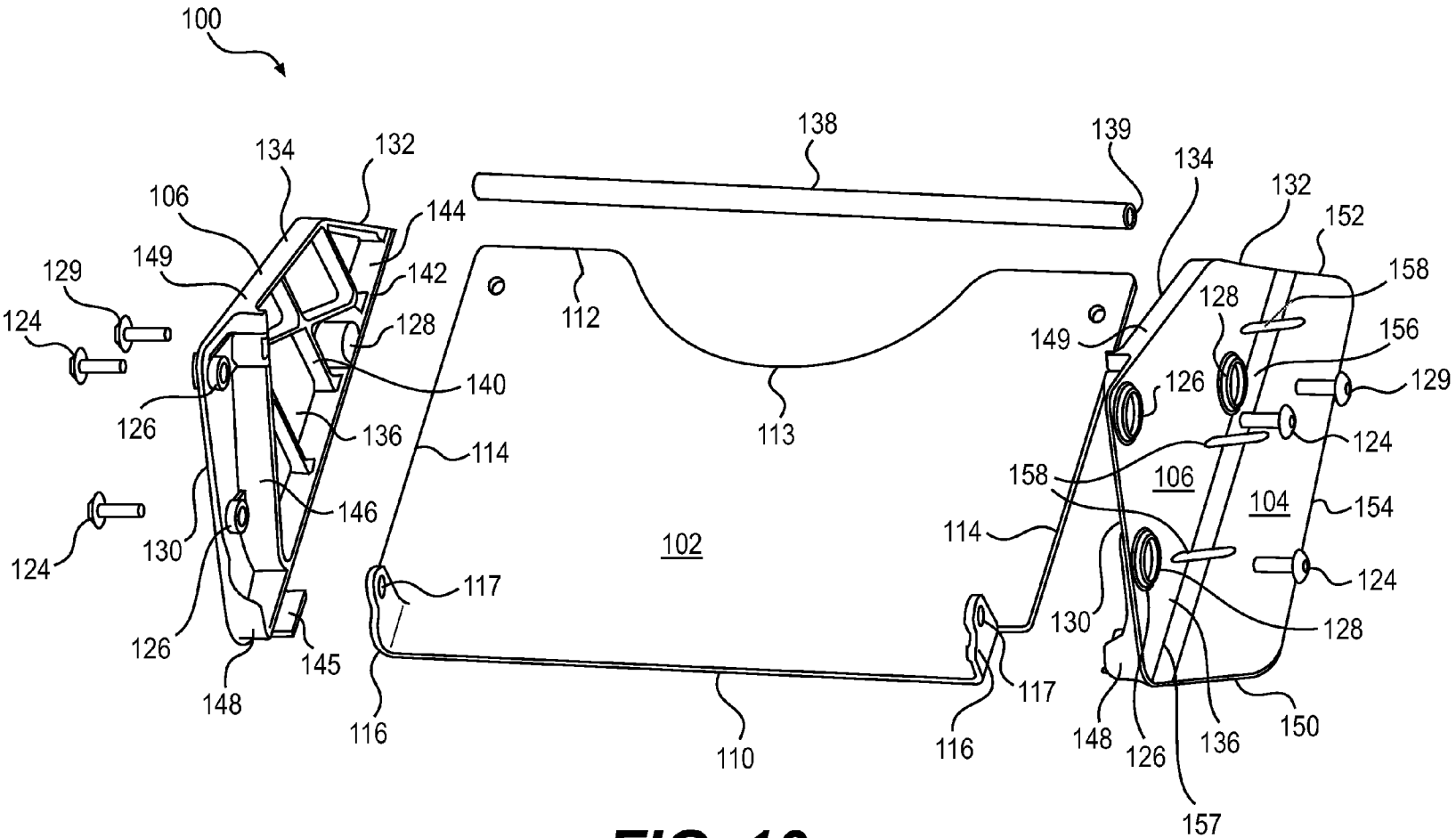
FIG. 10 is an exploded perspective view taken from a top, front and left side of the water deflector of FIG. 6.

The left deflection wing 104 has a front edge 150, a rear edge 152, a bottom edge 154 and an upper portion 156 attached to the lower portion 136 of the left mounting bracket 106. The front and rear edges 150, 152 slope downward and rearward. The front edge 150 slopes downward and rearward so as to avoid interference with the transom 16 and/or components attached thereto. The bottom edge 154 also slopes downward toward the rear. The upper portion 156 is aligned with the left lateral edge 114 of the deflection plate as can be seen in FIG. 9. The deflection wing 104 tapers towards the rear edge 152 such that the distance between an upper edge 157 (defined as being formed at the connection to the deflection plate 102) and the lower edge 154 is greater at the front edge 150 than at the rear edge 152. It is contemplated that the shape of the deflection wing 104 could be different than as shown.

As can be seen best in FIG. 9, the left deflection wing 104 flares downward and leftward (i.e. laterally outward from the left mounting bracket 106 and the deflection plate 102). The left surface (i.e. outer surface) of the left deflection wing 104 extends at an angle 160 with respect to the horizontal direction (i.e. in a direction extending leftward from the horizontal deflection late 102). In the illustrated embodiment, the angle 160 is 55°. In the illustrated embodiment, the inner and outer surfaces of each deflection wings 104 extend generally parallel to one another, so that the inner surface of the left deflection wing 104 extends an angle 162 of 125° with respect to the deflection plate 102. It is however contemplated that the inner and outer surfaces could not extend parallel to one another, and the angle 160 could not be complementary to the angle 162. It is contemplated that the angle 160 could be any angle greater than 30° (angle 162 could be any angle less than 150°). The angle 160 is preferably between 45° and 65° (i.e. the angle 162 is preferably between 115° and) 135° It is also contemplated that the deflection wings 104 be curved so that the angle 160 and/or 162 is different for different portions of the left deflection wing 104. It is contemplated that the planar deflection plate 102 could be curved instead of flat between its left and right lateral edges 114. For example, the deflector 100 could be configured so as to have a continuous curvature between the left lateral edge 114 of the lower surface of the deflection plate 102 and the upper edge 157 of the inner surface of the left deflection wing 104. It is also contemplated that the deflection plate 102 could be curved from the front edge 110 to the rear edge 112.

Three reinforcement ribs 158 are formed on the outer surface of the lower portion 136 of the mounting bracket 106 and the upper portion 156 of the deflection wing 102. The ribs 158 provide reinforcement where the mounting bracket 106 and the deflection wing 104 meet.

The deflection wing 104 and the mounting bracket 106 of each side are made of plastic and integrally formed with one another. More specifically, the deflection wing 104 and the mounting bracket 106 on each side of the water deflector 100 are molded to form a single piece. It is contemplated that the deflection wing 104 and the mounting bracket 106 could be made of any suitable materials.

It is also contemplated that the deflection wings 104 could be formed separately from the mounting bracket 106 and attached to one or both of the mounting bracket 106 and the deflection plate 102. It is contemplated that different deflection wings could be provided based on the structure of the boat, the outboard engine 10 and operating conditions.

It is contemplated that deflection wings 104 could be integrally formed with the deflection plate 102. It is further contemplated that the deflection plate 102, the deflection wings 104 and the mounting brackets 106 could all be formed integrally. It is further contemplated that the defector 100 could be formed integrally with the stern bracket 51.

It should also be understood that the configuration of the stern bracket 51 and the swivel bracket 50 of the bracket assembly could be different than as described. For example, the stern bracket 51 could include a single central support member 52. In this case the deflector plate 102 could be connected to the support member 52 by a single mounting bracket 106, or by the left and right mounting brackets 106 as in the illustrated embodiment. It is also contemplated that the support members 52*a*, 52*b* could extend at an angle to the vertical direction, or the support members 52*a*, 52*b* could not be connected directly to the transom 16.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A stern bracket for mounting a drive unit to a watercraft, the drive unit being pivotable with respect to the stern bracket about a tilt axis, the watercraft including a transom, the stern bracket comprising:

a support member for fixing the drive unit to the transom; and a water deflector comprising:

a mounting bracket attached to the support member;

a deflection plate connected to the mounting bracket, the deflection plate being disposed at a vertical position lower than the tilt axis and extending between the transom and the drive unit when the drive unit is mounted to the stern bracket and the stern bracket is mounted to the transom;

a left deflection wing connected to at least one of the deflection plate and the mounting bracket, the left deflection wing extending downward and laterally outward from the at least one of the deflection plate and the mounting bracket; and a right deflection wing being connected to at least one of the deflection plate and the mounting bracket, the right deflection wing extending downward and laterally outward from the at least one of the deflection plate and the mounting bracket.

2. The stern bracket of claim 1, wherein the deflection plate extends downward and rearward from a front edge thereof proximate the transom to a rear edge thereof.

3. The stern bracket of claim 1, wherein at least a portion of a rear edge of the deflection plate is recessed for receiving a front surface of an outboard engine mounted to the watercraft by the stern bracket.

4. The stern bracket of claim 1, wherein the deflection plate is fastened to the support member.

5. The stern bracket of claim 1, wherein:

an inner surface of the left deflection wing extends at a wing angle with respect to a lower surface of the deflection plate; and the wing angle is less than 150°.

6. The stern bracket of claim 5, wherein the wing angle is between 115° and 135°.

7. The stern bracket of claim 5, wherein the wing angle is 125°.

8. The stern bracket of claim 1, wherein:

each of the left and right deflection wings comprises a front edge, and at least a portion of the front edge of each deflection wing is generally aligned with a front edge of the deflection plate in a longitudinal direction.

9. The stern bracket of claim 1, wherein:

each of the left and right deflection wings comprises a rear edge, and at least a portion of the rear edge of each deflection wing is generally aligned with a rear edge of the deflection plate in a longitudinal direction.

10. The stern bracket of claim 1, wherein:

each of the left and right deflection wings comprises a front edge, a rear edge, and a bottom edge, and for each deflection wing, the bottom edge slopes downwards and rearwards from the front edge to the rear edge of the deflection wing.

11. The stern bracket of claim 1, wherein the mounting bracket comprises a left mounting bracket and a right mounting bracket, the left mounting bracket being attached to a left portion of the support member, the left deflection wing being connected to at least one of the deflection plate and the left mounting bracket, the right mounting bracket being attached to a right portion of the support member, and the right deflection wing being connected to at least one of the deflection plate and the right mounting bracket.

12. The stern bracket of claim 11, wherein the deflection plate has a left lateral edge and a right lateral edge, each of the left and right lateral edges being received in a channel formed in a corresponding one of the left and right mounting brackets.

13. The stern bracket of claim 11, further comprising a sacrificial anode extending laterally between the left and right portions of the support members, and being attached to at least one of:

the left and right mounting brackets; and the deflection plate.

14. The stern bracket of claim 13, wherein the deflection plate further comprises:

a left tab and a right tab extending upwards respectively from a left lateral edge and a right lateral edge of the deflection plate, the left and right tabs being disposed laterally between the left and right portions of the support members;

a shaft connected between the left and right tabs, the shaft being made of a material that is non-corrodible in salt water; and the sacrificial anode being mounted on the shaft.

15. The stern bracket of claim 11, wherein:

an upper portion of the left deflection wing is attached to a lower portion of the left mounting bracket; and an upper portion of the right deflection wing is attached to a lower portion of the right mounting bracket.

16. The stern bracket of claim 15, wherein:

the left mounting bracket and the left deflection wing are integral; and the right mounting bracket and the right deflection wing are integral.

17. A watercraft comprising:

a transom;

a drive unit comprising:

a driveshaft defining a driveshaft axis;

a propeller shaft operatively connected to the driveshaft; and a propeller connected to the propeller shaft; and a bracket assembly comprising:

a swivel bracket connected to the drive unit, the drive unit being pivotable with respect to the swivel bracket about a steering axis generally parallel to the driveshaft axis; and a stern bracket, the swivel bracket being pivotable with respect to the stern bracket about a tilt axis perpendicular to the steering axis and the propeller shaft, the stern bracket comprising:

a support member for fixing a drive unit to the transom; and a water deflector comprising:

a mounting bracket attached to at least one of the support member and the transom;

a deflection plate connected to the mounting bracket, the deflection plate being disposed at a vertical position lower than the tilt axis and extending between the transom and the drive unit;

a left deflection wing connected to at least one of the deflection plate and the mounting bracket, the left deflection wing extending downward and laterally outward from the at least one of the deflection plate and the mounting bracket; and a right deflection wing being connected to at least one of the deflection plate and the mounting bracket, the right deflection wing extending downward and laterally outward from the at least one of the deflection plate and the mounting bracket.

18. The watercraft of claim 17, wherein the deflection plate extends downward and rearward from a front edge thereof proximate the transom to a rear edge thereof.

19. The watercraft of claim 17, wherein:

an inner surface of the left deflection wing extends at a wing angle with respect to a lower surface of the deflection plate; and the wing angle is less than 150°.

20. The watercraft of claim 17, wherein the mounting bracket comprises a left mounting bracket and a right mounting bracket, the left mounting bracket being attached to a left portion of the support member, the left deflection wing being connected to at least one of the deflection plate and the left mounting bracket, the right mounting bracket being attached to a right portion of the support member, and the right deflection wing being connected to at least one of the deflection plate and the right mounting bracket.

* * * * *